United States Patent [19]

Fuchs

[11] 4,301,701

[45] Nov. 24, 1981

[54] ROTARY PUNCH HAVING A HELICALLY CLAMPED ABUTMENT

[75] Inventor: Siegfried Fuchs, Neuwied, Fed. Rep. of Germany

[73] Assignee: Winkler & Dunnebier Maschinenfabrik und Eisengiesserei GmbH & Co. KG, Neuwied, Fed. Rep. of Germany

[21] Appl. No.: 119,266

[22] Filed: Feb. 7, 1980

[30] Foreign Application Priority Data

Feb. 8, 1979 [DE] Fed. Rep. of Germany ..... 2904698

[51] Int. Cl.[3] ..... B26D 1/02; B26D 1/62

[52] U.S. Cl. ..... 83/349; 83/658; 83/698

[58] Field of Search ..... 83/341, 349, 342, 658, 83/659, 698

[56] References Cited

U.S. PATENT DOCUMENTS

| | | | |
|---|---|---|---|
| 3,073,196 | 1/1963 | Marcalus | 83/341 |
| 3,119,312 | 1/1964 | Henc | 83/698 X |
| 3,595,117 | 7/1971 | Grettve | 83/349 |
| 3,611,855 | 10/1971 | Thousand, Jr. | 83/349 X |
| 3,779,123 | 12/1973 | Chafee | 83/698 |
| 3,823,633 | 7/1974 | Ross | 83/698 X |

*Primary Examiner*—Frank T. Yost

*Attorney, Agent, or Firm*—Allison C. Collard; Thomas M. Galgano

[57] ABSTRACT

A rotary punch for the production of pre-shaped outer and inner cuts on moving webs or individual blanks of paper or the like, and more particularly, for the preparation of envelopes, flat bags or the like, includes rotating cutting tools whose cutting edges describe an envelope cylinder and at the instant of cutting impinge on a stationary abutment aligned at a slight inclination to the axis of rotation of the tools and so clamped that the operative edge of the abutment is everywhere at the same radial distance from the axis of rotation. The punch has a holder for the abutment, which holder has a bed molded from a curable liquid, and a cutting ledge of circular cross-section which is secured in the bed.

5 Claims, 2 Drawing Figures

ROTARY PUNCH HAVING A HELICALLY CLAMPED ABUTMENT

The invention relates to a rotary punch for the production of pre-shaped outer and inner cuts on moving webs or individual blanks of paper or the like. More particularly, it relates to the preparation of envelopes, flat bags or the like, by means of rotating cutting tools whose cutting edges describe or delineate an envelope cylinder and, at the instant of cutting, impinge on a stationary abutment.

The invention relates to an improvement of the device disclosed in German patent sepcification 1,962,984. Therein the abutment, in the form of a hard-metal ledge having a square cross-section, is aligned at a slight inclination to the axis of the rotation of the cutting tools in order to produce a drawing cut. The ledge is so clamped in its retaining means that the operative edge of the abutment, along its entire length, is substantially at the same radial distance from the axis of rotation of the cutting tools.

Accordingly, the hard metal ledge serving as the abutment is clamped, by means of a clamping member, in a correspondingly-shaped groove and, because of the clamping, is deformed. A disadvantage of this concept is that the required constant radial distance between the operative edge of the abutment and the axis of rotation of the cutting tools can be achieved only if the hard-metal ledge is twisted on itself slightly as a result of the distortion caused by clamping. Unfortunately, this feature leads to production engineering difficulties in the formation of the groove for receiving the hard-metal ledge and so is normally not used; consequently, the constant interval feature can only be an approximation.

It is therefore the object of the invention to provide a device in which, although the cost of production is low, the operative edge of the abutment is, over the whole length thereof, at exactly the same radial distance from the axis of rotation of the cutting tools.

This and other related objects are attained in accordance with the present invention by the provision of a rotatable punch having a holder for the abutment, which holder has a bed molded in a curable liquid, and a cutting ledge of circular cross-section which is secured in the holder bed.

A main advantage of this device is that, even with the cost of production being kept low, an abutment is provided which, over its whole length, is at the same radial distance from the axis of rotation of the rotating cutting tools.

Figure 1:
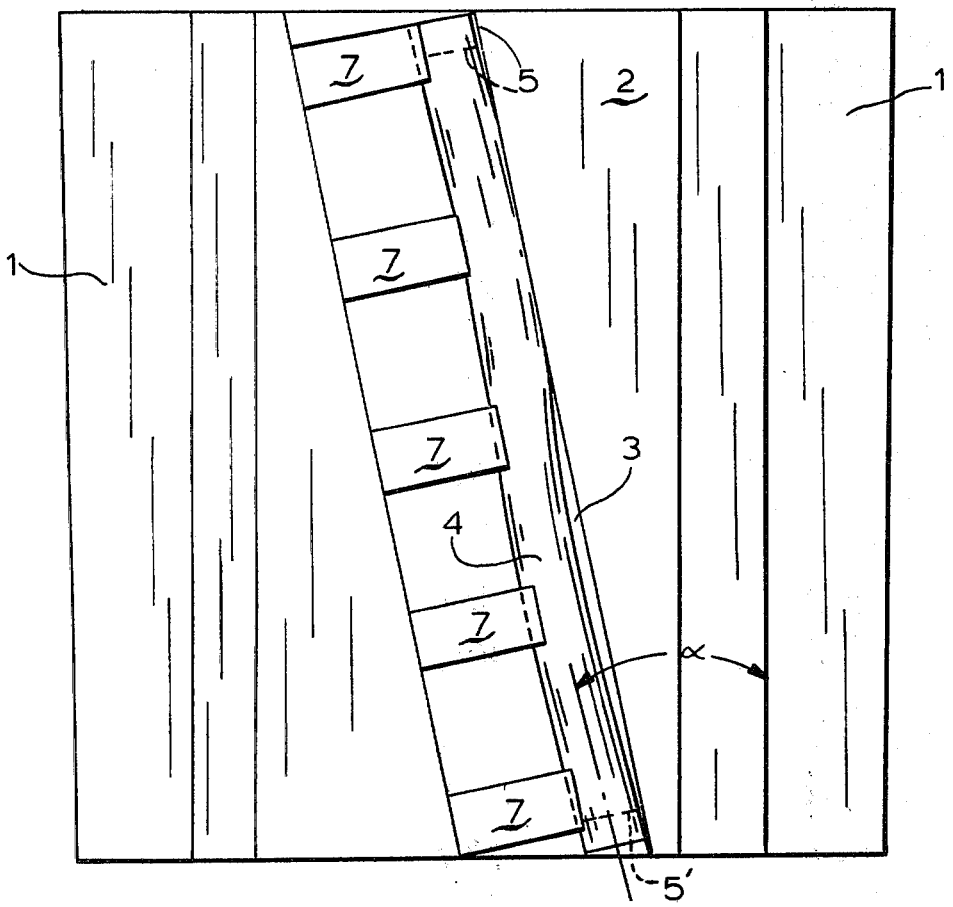
Figure 2:
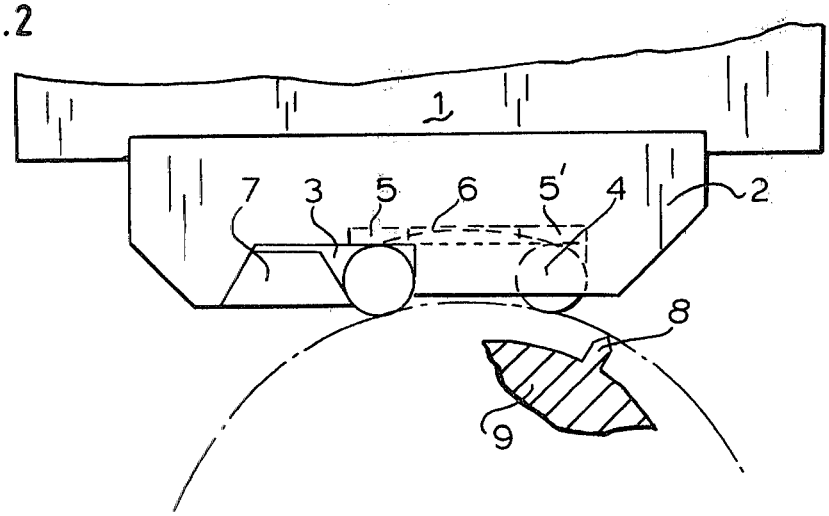

The invention will be described in greater detail hereinafter with reference to the appended diagrammatic drawings which, for the sake of clarity, give a very exaggerated view of the inclined position of the abutment and in which:

FIG. 1 is an inverted plan view of the abutment, clamped in a holder, of the rotary punch embodying the present invention; and FIG. 2 is a side view of the rotary punch.

Referring now in detail to the drawings, the rotary punch basically comprises a bridgepiece 1 on which is mounted an abutment holder 2 formed with a stepped groove 3. The abutment proper, in the form of a cutting ledge 4 of circular cross-section which is preferably made of a ceramic material, is disposed in the deeper portion of groove 3 and is supported just at both its ends on metallic support 5, 5'; the intermediate region therebetween is supported in a bed 6 formed by a cured pourable plastic, e.g., a liquid plastic, used to fill the lower portion of the groove 3. A number of wedge-shaped clamping elements 7 engage cutting ledge 4, over its entire length, in cooperation with bed 6. The shape of the bed 6 is such that cutting ledge 4 engages helically around the cutting roll 9 carrying the shaping tool 8. As a simple way of achieving this shape of the bed 6, the cutting ledge 4 is impressed into the material of the bed in a device simulating the rotary punch and before the curing of the bed material by means of a roller which crosses the ledge 4 at an inclination $\alpha$ of approximately 1° and which is of the same diameter as the envelope circle delineated by the cutting tool 8; the ledge 4 is, of course, retained in the bed material until the same has cured.

While only a single embodiment of the present invention has been shown and described, it will be obvious that many modifications and changes may be made therein, without departing from the spirit and scope of the invention.

What is claimed is:

1. In a rotary punch for the production of pre-shaped outer and inner cuts on moving webs or individual blanks of paper or the like, which includes rotating cutting tools having cutting edges which delineate an envelope cylinder and a stationary abutment against which said cutting edges impinge at the instant of cutting and which has an operative cutting ledge which is aligned at a slight inclination to the axis of rotation of said tools and which abutment is so clamped that said ledge thereof, over the entire length thereof, is at the same radial distance from said axis, the improvement comprising:

a holder for said abutment having a bed formed and molded from a curable liquid; and said stationary abutment has an elongated, continuous cutting ledge of circular cross-section secured in said liquid of said bed.

2. The punch according to claim 1, wherein said curable liquid is a liquid synthetic resin.

3. The punch according to claim 1, wherein said cutting ledge is made of a ceramic material.

4. The punch according to claim 1, wherein said abutment holder has a groove formed therein in which said bed is located and wherein non-deformable support members are disposed in said groove for supporting the ends of said cutting ledge.

5. The punch according to claim 1, wherein clamping members are distributed over the length of said cutting ledge.

* * * * *